United States Patent [19]

Smith et al.

[11] Patent Number: 4,973,268

[45] Date of Patent: Nov. 27, 1990

[54] MULTI-CONTACT ELECTRICAL CONNECTOR WITH SECONDARY LOCK

[75] Inventors: Albert R. Smith, Ararat, N.C.; Allen F. VanDerStuyf, Rochester Hills, Mich.

[73] Assignee: AMP Incorporated, Harrisburg, Pa.

[21] Appl. No.: 419,573

[22] Filed: Oct. 10, 1989

[51] Int. Cl.[5] ..... H01R 13/424

[52] U.S. Cl. ..... 439/595; 439/598; 439/594; 439/589

[58] Field of Search ..... 439/281, 282, 589, 592, 439/594, 596, 598, 599, 603

[56] References Cited

U.S. PATENT DOCUMENTS

| | | | |
|---|---|---|---|
| 3,601,760 | 8/1971 | Cairns | 339/59 |
| 4,319,799 | 3/1982 | Pearce, Jr. | 339/217 R |
| 4,443,048 | 4/1984 | Moist, Jr. | 339/63 M |
| 4,544,220 | 10/1985 | Aiello et al. | 339/59 M |
| 4,557,542 | 12/1985 | Coller et al. | 339/59 M |
| 4,611,880 | 9/1986 | Petersen et al. | 439/599 |
| 4,655,525 | 4/1987 | Hunt et al. | 339/59 M |
| 4,708,662 | 11/1987 | Klein | 439/353 |
| 4,787,864 | 11/1988 | Hunt et al. | 439/595 |
| 4,806,123 | 2/1989 | Konishi et al. | 439/603 |
| 4,810,208 | 3/1989 | Hayes et al. | 439/589 |
| 4,820,198 | 4/1989 | Lulko et al. | 439/599 |
| 4,850,888 | 7/1989 | Denlinger et al. | 439/594 |
| 4,874,325 | 10/1989 | Bensing et al. | 439/281 |
| 4,902,247 | 2/1990 | Suzuki et al. | 439/595 |

*Primary Examiner*—Paula A. Bradley

*Attorney, Agent, or Firm*—Robert W. Pitts; Allan B. Osborne

[57] ABSTRACT

A sealed electrical connector assembly 2 used to interconnect wires 4 with a printed circuit board comprises a receptacle connector 6 matable with a pin header 8. The receptacle connector 6 includes a secondary lock 60 located on the mating face of an insulative housing 30. Integral latches 50 are received within correspondingly shaped pocket 62 in the secondry lock. A conductor seal cap includes a plurality of projections which can be selectively removed. Remaining projections seal individual seal cavities. A stamped and formed pin is used in the pin header. An integral plug is used to seal the leak path on the interior of the stamped and formed cylindrical pins.

38 Claims, 12 Drawing Sheets

28
24a
24b
26a
27
136a
136b
120
126
138
124a
124b
128
130
20
22
26b
29
13

4
19
18
16
17
15
12
10
14
28
20
24a
24b
26a
27
26b
29
120
138
24b

MULTI-CONTACT ELECTRICAL CONNECTOR WITH SECONDARY LOCK

BACKGROUND OF THE INVENTION

1. Field of the Invention

The present invention relates to an electrical connector assembly in which a secondary lock is provided to secure contact terminals within an insulative housing and more particularly to an electrical connector having a plurality of rows of contact terminals spaced in a densely populated array.

2. Description of the Prior Art

Many conventional electrical connectors employ some sort of secondary locking or terminal position assurance member to insure that electrical terminals are properly seated within a connector housing. Such connectors are commonly employed in the automotive industry. Conventional electrical connectors of this type can employ either lanced or lanceless contact terminals. A lanced contact terminal would have a metal lance projecting from one surface. Lanced contacts have certain drawbacks. For example, the presence of a protruding lance on a contact may cause problems for a harness maker since the protruding contacts may snag wires in the harness during assembly. Also, lance contacts, which are normally resiliently deflectable upon insertion into a housing, may be plastically deformed such that the lance is not properly redeployed and does not establish a satisfactory engagement with the insulative housing. For this reason, many electrical connectors employ lanceless contact terminals in which a resilient contact member is deflected upon insertion of the lanceless terminal into the housing. The deflectable plastic latch used with lanceless contacts is normally cammed upon insertion of a contact and then returns to engage a shoulder on the contact terminal. Electrical connectors using lanceless contact terminals quite often employ a secondary lock in the form of a comb or other member which can be inserted into the insulative housing and into engagement with a surface on the lanceless contact. Secondary locking members which are insertable into engagement with a primary resilient latch are also used on conventional multi-contact electrical connectors.

U.S. Pat. 4,557,542 discloses an electrical connector employing a secondary lock wedge bar which is inserted through the mating face of the connector. Portions of this wedge can be inserted into a cavity between two deflectable latch arms which form part of the insulative housing which terminals are received. The wedge shaped secondary locking bar insertable into this connector can only be inserted between the deflectable latch arms if the latch arms are in proper position securing lanceless terminals in the insulative housing.

An alternative method of locking terminals in a housing is disclosed in U.S. Pat. No. 4,319,799 which includes a lock plate attached to the mating face of the connector body. This lock plate can be inserted onto the mating face of the connector into engagement with hooks placed on the front of contact terminals received within the connector body. Terminals can subsequently be positively locked as a group by inserting a comb through slots in the floor of the connector body and into engagement with the terminals.

U.S. Pat. No. 4,655,525 and U.S. Pat. No. 4,787,864 each disclose a different terminal retainer or secondary lock configuration. In each of these patents, a locking insert is inserted into the rear of the housing to secure the terminals in place. These inserts are insertable behind deflectable resilient sections of the housing which provide room for the insert only when the terminal is properly positioned within the housing.

U.S. Pat. No. 3,601,760 discloses an electrical connector employing lanceless contact terminals. These terminals have a recess located between areas in which the terminal has a larger cross-section. Flexible wall sections of the housing are received within this recess when the terminals are appropriately positioned and a separate locking bar can be inserted behind the flexible walls when the terminals are properly positioned in the housing.

Each of the aforementioned electrical connectors employ secondary locking members with connectors having two rows of terminals. Furthermore, each of the aforementioned electrical connectors employ a secondary locking member which comprises a separate piece and must be inserted into the housing after the contact terminals have been positioned within the housing. U.S. Pat. No. 4,708,662 discloses a connector assembly with a prestaged terminal retainer secured to the main body of the housing at the rear of the housing. This terminal retainer has a plurality of resilient fingers having a conical configuration. These resilient fingers retain the terminals in position. The resilient fingers are inserted into conical cavities in an insulative housing when the resilient fingers in this soft shell connector have collapsed into engagement with a circumferential recess on the contact terminal. U.S. Pat. No. 4,443,048 and U.S. Pat. No. 4,544,220 disclose connectors also having resilient fingers engaging terminals. These retainer members can be attached to the soft shell housing of an electrical connector after the terminals are secured within the retainer. The device shown in U.S. Pat. No. 4,443,048 does not employ any secondary locking feature. The electrical connector shown in U.S. Pat. No. 4,544,220 does employ a secondary locking capability.

None of these conventional electrical connectors provide for dense population of electrical terminals in multiple rows in a secondary lock connector. The instant invention provides such a configuration.

SUMMARY OF THE INVENTION

This invention relates to an electrical connector comprising a plurality of terminals positioned within an insulative housing and secured to the housing by a plurality of latches. A secondary housing member is mounted on the front of the insulative housing in telescoping relationship to the housing. This secondary housing member, or secondary lock, has a plurality of pockets arranged in multiple rows. The latches fit within pockets in the secondary lock only when the latches are in proper position securing the terminals within the insulative housing. The secondary lock can be secured to the insulative housing by two position retainer means. This configuration permits dense population of electrical terminals since the pockets and the latches can partially overlap in adjacent rows. In the preferred embodiment of this invention, a three row connector is employed with the terminal positions in the center row being staggered with respect to the outer two rows to permit close spacing between terminals. The pockets in the secondary lock in the preferred embodiment of this invention would be defined by diagonal wall sections and would have a generally diamond shaped configuration. Resilient latches would have a triangular cross section and two latches would be insertable in the single diamond shaped pocket.

BRIEF DESCRIPTION OF THE DRAWINGS

FIG. 3 is an exploded view showing the plastic parts and elastomeric sealing elements of the receptacle connector.

FIG. 8 shows final assembly of the connector with the secondary lock feeding the resilient latches in pockets formed in the secondary lock.

FIG. 13A is a section view taken through the plug along section lines 13—13 as shown in FIG. 12.

FIG. 13B is a section view showing a first intermediate step in the fabrication of the plugged stamped and formed cylindrical pin.

FIG. 13C is a section view showing a second intermediate step in the fabrication of the plugged stamped and formed cylindrical pin.

FIG. 15 is a exploded perspective view of the receptacle terminal and the stamped and formed cylindrical pin.

DETAILED DESCRIPTION OF THE PREFERRED EMBODIMENT

Figure 1:
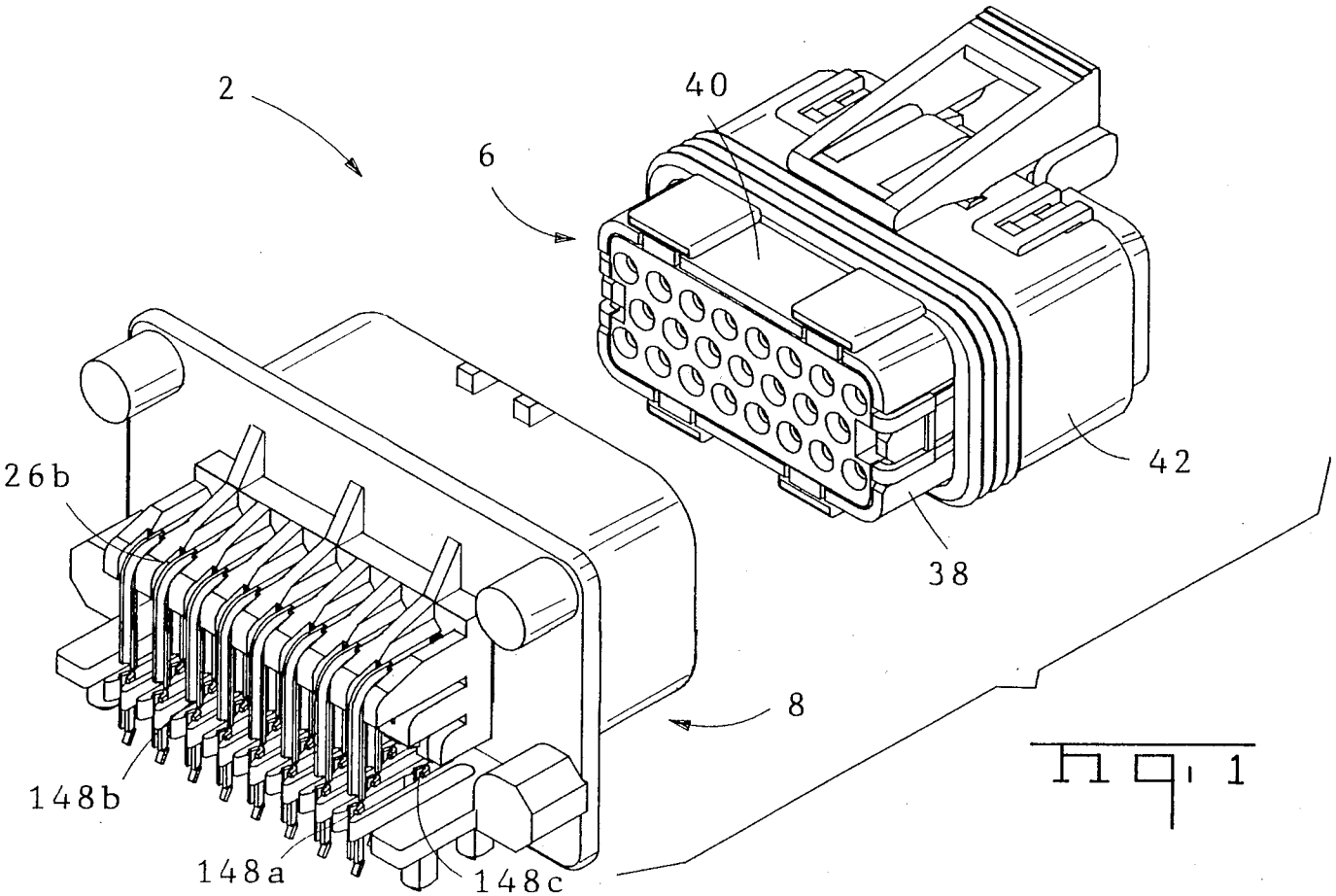
FIG. 1 is a perspective view showing a circuit board header and a receptacle connector exploded from the pin header with which the receptacle connector would mate.

The sealed electrical connector assembly comprising the preferred embodiment of this invention is intended for use in establishing sealed interconnection to conductors in a densely populated array. The sealed connector assembly 2 comprising the preferred embodiment of this invention be used with conductors at any arbitrary location, less than the total number of terminal position in the housing. Sealing integrity is established with each of the electrical conductors, such as wires, and sealing integrity can be established with individual wires and along individual circuits even though all of the positions in the connector are not filled with terminals. Electrical connector or receptacle connector 6 is employed to mate with a mating connector or shrouded pin header 8. Electrical terminals 10 are mounted in the electrical connector 6 in a plurality of rows. In the preferred embodiment of this invention terminals 10 are mounted in three rows, the center row being staggered with respect to the terminal positions in the outer two rows. Terminals 10 are attached to wires 4 and are matable with stamped and cylindrically formed or tubular pins 20. Terminals 10 are positioned within an insulative housing 30 and the pins 20 are positioned within a header housing 140 of the pin header 8.

Figures 5, 14:
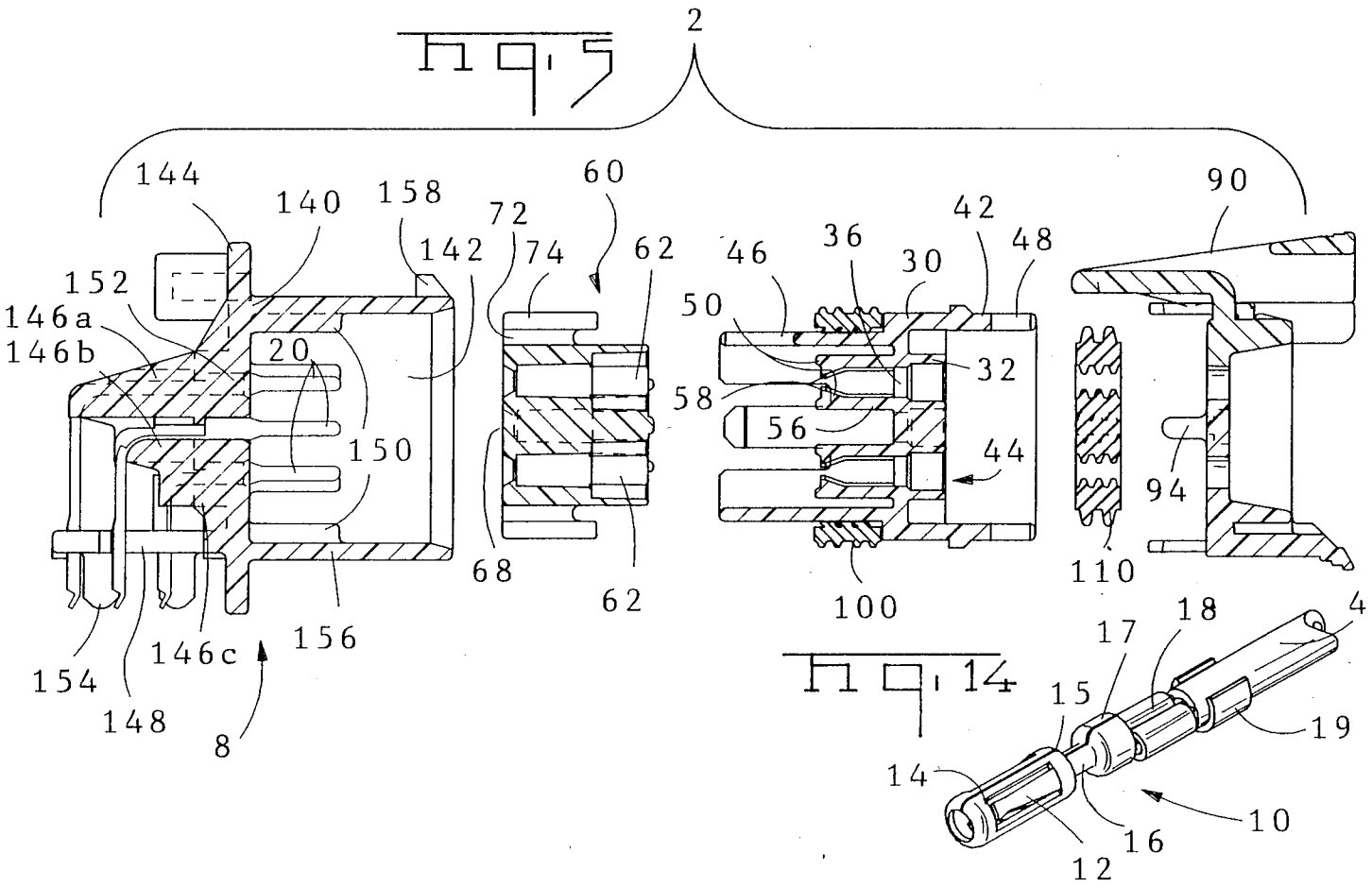
FIG. 5 is an exploded sectional view showing the parts of the connector shown in FIGS. 3 and 4.
FIG. 14 is a perspective view of the receptacle terminal employed in the receptacle connector.

Each of the terminals 10, as shown in FIG. 14, include a plurality of contact springs 12 which are in the form of cantilever beams positioned within a tubular or barrel contact section 14. In the preferred embodiment of this invention these contact springs 12 extend forwardly from the rear of the barrel shaped sections toward the front. A shoulder 15 is formed at the rear of the barrel contact section 14 and a waist section 16, having a reduced outer diameter, is formed between the barrel contact section 14 and a stabilizing section 17 having an outer diameter substantially equal to the outer diameter of the barrel contact section 14. Barrel shoulder 15 forms a well defined shoulder between the barrel contact section 14 and the waist section 16. A conventional wire crimp section 18 is located adjacent the cylindrical stabilizing section 17 and an insulation crimp 19 of conventional wrap around construction is located at the rear of terminal 10. The terminal is crimped in such a manner that the elastomeric seals will not be damaged when a crimped terminal is inserted through the seal. Each terminal 10 can be crimped to a stripped end of a wire 4 in a conventional manner.

Terminals 10 are positioned within a insulative housing 30 having an insulative base 32 through which a plurality of openings or cavities extend in rows corresponding to the rows in the array of terminal positions. These openings or cavities 36 form means for positioning terminals in three staggered rows extending between opposite end walls 38 of the insulative housing 30 and parallel to opposite sidewalls 40. Housing 30 has a mating face 34 which is at the free end a rectangular mating envelope formed by opposite end walls and opposite sidewalls. The end walls 38 and sidewalls 40 forming this mating envelope extend forward from the insulative housing base 32. Insulative housing 30 is open within the envelope formed by end walls 38 and sidewalls 40 from the insulative housing base forward. A plurality of grooves 46 are provided in each sidewall 40. In the preferred embodiment of this invention the grooves 46 in the upper sidewall are spaced apart by different distance than the grooves 46 in the lower sidewall. The grooves 46 thus polarize the mating envelope formed at the mating face 34 of the insulative housing 30.

An insulative housing shroud 42 is located at the rear end of the insulative housing and extends rearwardly from the insulative housing base 32. Housing shroud 42 protrudes beyond the sidewalls 40 and beyond the end walls 38 such that the mating envelope has smaller outer dimensions than the housing shroud 42. A shoulder is formed at the juncture between the end walls 38 and the sidewalls 40 forming the mating envelope and the housing shroud 42. A plurality of grooves 48 adjacent the rear end 44 of the housing are also formed in the shroud 42. Again, grooves in opposite walls of the housing shroud are located in a different configuration on the top and bottom walls of the shroud 42 to polarize the housing shroud.

Figure 18:
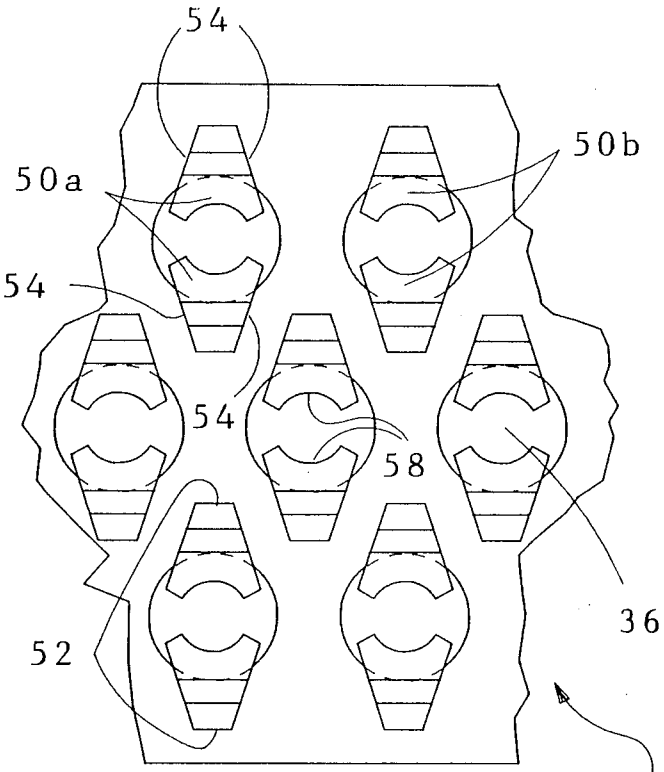
FIG. 18 is a front view showing the shape of the latches used on the insulative housing.

A plurality of resilient plastic latches 50, integral with the insulative housing 30 extend from the insulative housing base 32 towards the mating face 34. Each of these latches 50 comprises means for securing terminals in the insulative housing. Latches 50 are located on the interior of end walls 38 and sidewalls 40 within a large mating cavity on the insulative housing. Each of the latches comprises a resiliently deflectable beam extending from base 32. As best seen in FIG. 18, each of the latches 50 has a generally triangular cross section with exterior surfaces 54 of each latch converging towards an apex 52 with distance away from the respective terminal 10 secured by the latch. In other words, the exterior surfaces 54 of each latch 50 converge towards an apex 52 with distance away from the center line of the opening 36 in the insulative base 32. Two latches, positioned in surrounding relationship to each terminal 10 protrude from the insulative housing base 32 on the periphery of each opening 36 to secure each terminal extending through and positioned by each corresponding opening 36. Since the exterior surfaces 54 of each opposed pair of latches 50 converge towards opposite apices 52, each opposed pair of latches generally forms a diamond shape configuration. Engaging surfaces 58 in the form of curved lips protrude inwardly from the triangular shaped cantilever beams 56 forming the latches 50. These engaging lips 58 protrude into the cylindrical contour of the openings 36 and provide a means for gripping a terminal 10 inserted through an opening 36.

The latches 50 in each row are staggered with respect to latches 50 in an adjacent row. The tapered latches 50 can be positioned in partially overlapping relationship. In this manner the rows of terminal positions in the terminal array can be more closely spaced. In other words, openings 36 can be more closely spaced. In this manner a denser population of terminal positions can be achieved. As shown in FIG. 18 the apices of latches in each outer row overlap the apices 52 of latches 50 in the adjacent center row.

Figure 19:
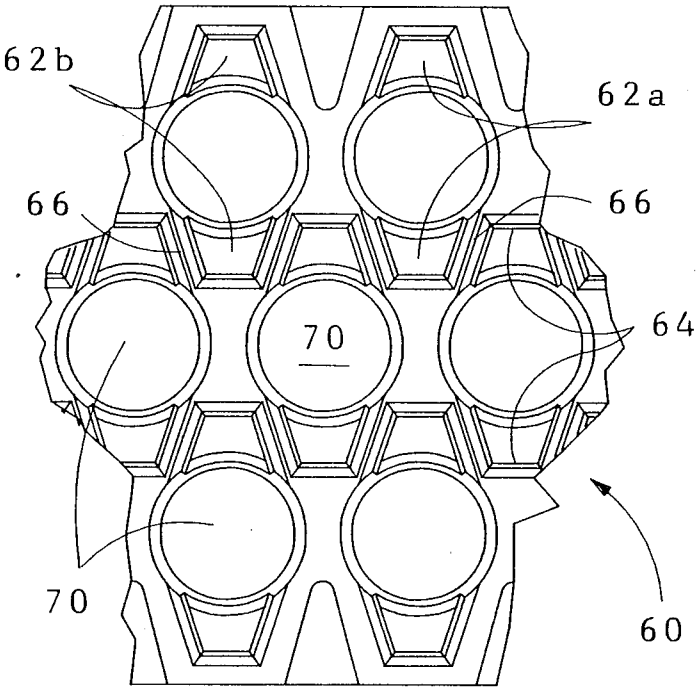
FIG. 19 is a front view showing the shape of the individual pockets employed in the secondary lock member.

Secondary housing member 60, mountable in telescoping relationship to the front of the insulative housing 30, comprises a secondary lock. Secondary lock 60 is shiftable from a first position shown in FIGS. 6 and 7 to a second position shown in FIG. 8. Secondary lock 60 has a plurality of pockets 62 arranged in a plurality of rows in the secondary lock 60. As shown in FIG. 19, individual pockets are substantially diamond shaped with the apices 64 of pockets in adjacent rows overlapping. In the preferred embodiment of this invention the pockets are located in three rows with the pockets in the center row be staggered with respect to pockets in the outer two rows. As with latches 50, pockets 62 only partially overlap pockets in adjacent rows. The pockets 62 are formed by diagonal wall sections 66 which are interwoven to define a honeycomb structure. Diagonal wall section 66 extend rearwardly from an outer secondary housing member base or outer partition 68. Apertures 70 in the form of generally circular holes, having a tapered end adjacent the outer face of the secondary lock 60, have a generally circular or cylindrical shape and each aperture 70 is aligned with a corresponding diamond shaped pocket 62. The diagonal wall section 66 located beyond each aperture 70 such that the diamond shaped pocket 62 align with aperture 70 are generally larger than the aperture 70. The diagonal wall sections are located only on the interior of the secondary lock 60 and extend from the rear of the aperture 70 to the rear end of the secondary lock 60. Note that the apertures 70 have generally circular cross-section which merges with the diamond shaped cross-section of the pocket defined by the diagonal wall sections 66. As with the pockets 62 the aperture 70 are staggered in adjacent rows. Each aperture 70 is offset from diagonal wall section 66 in a secondary lock 60 so that mating terminals in the form of pins 20 can be inserted through apertures 70 and the pins will be spaced from the diagonal wall sections 66.

As best shown in FIGS. 18 and 19, the shape of the latch pairs 50 and the corresponding pockets 62 are substantially the same so that the latches 50 can be inserted into corresponding pockets 62. Latches 50 are however received in respective pockets 62 only when the secondary lock 60 is in the second position shown in FIG. 8 and when the latches 50 are in a position securely engaging corresponding terminals 10.

Secondary lock 60 includes a plurality of tongues 72 extending outwardly from opposite sidewalls 40. The tongues merge with a laterally extending platform 74 so that each tongue and platform essentially has a T shaped configuration. Tongues 72 are positioned to correspond with the location of grooves 46 on the top and bottom sidewalls 40 of housing 30. Tongues 72 interfit with the grooves 46 so that the pattern of tongues and grooves provide a keyed orientation between the insulative housing and the secondary lock 60. The integral tongue 72 and platform 74 also provide a means for orienting or keying the connector 6 with respect to a mating connector 8 since these T-shaped tongues and platform configurations are located adjacent to mating face of connector 6.

Figures 7, 20, 21:
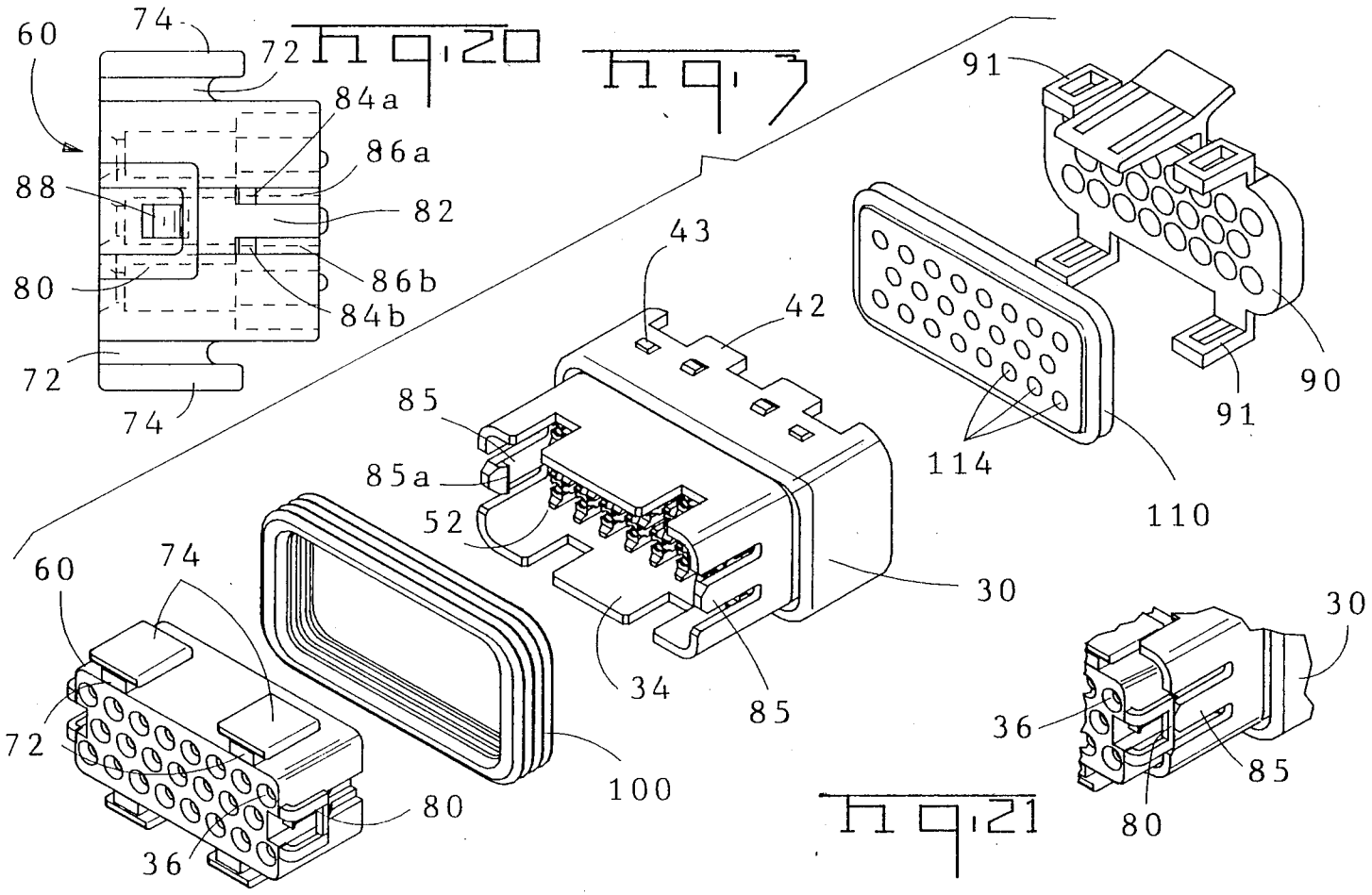
FIG. 7 is a view similar to FIG. 6 showing complete insertion of a terminal into the insulative housing.
FIG. 20 is a side view of the secondary lock showing two position retainer elements on the secondary lock.
FIG. 21 shows the secondary lock member in the shipped configuration with the latching finger engaging the strap to prevent the secondary lock from inadvertently shifting to the closed position.
Figure 4:
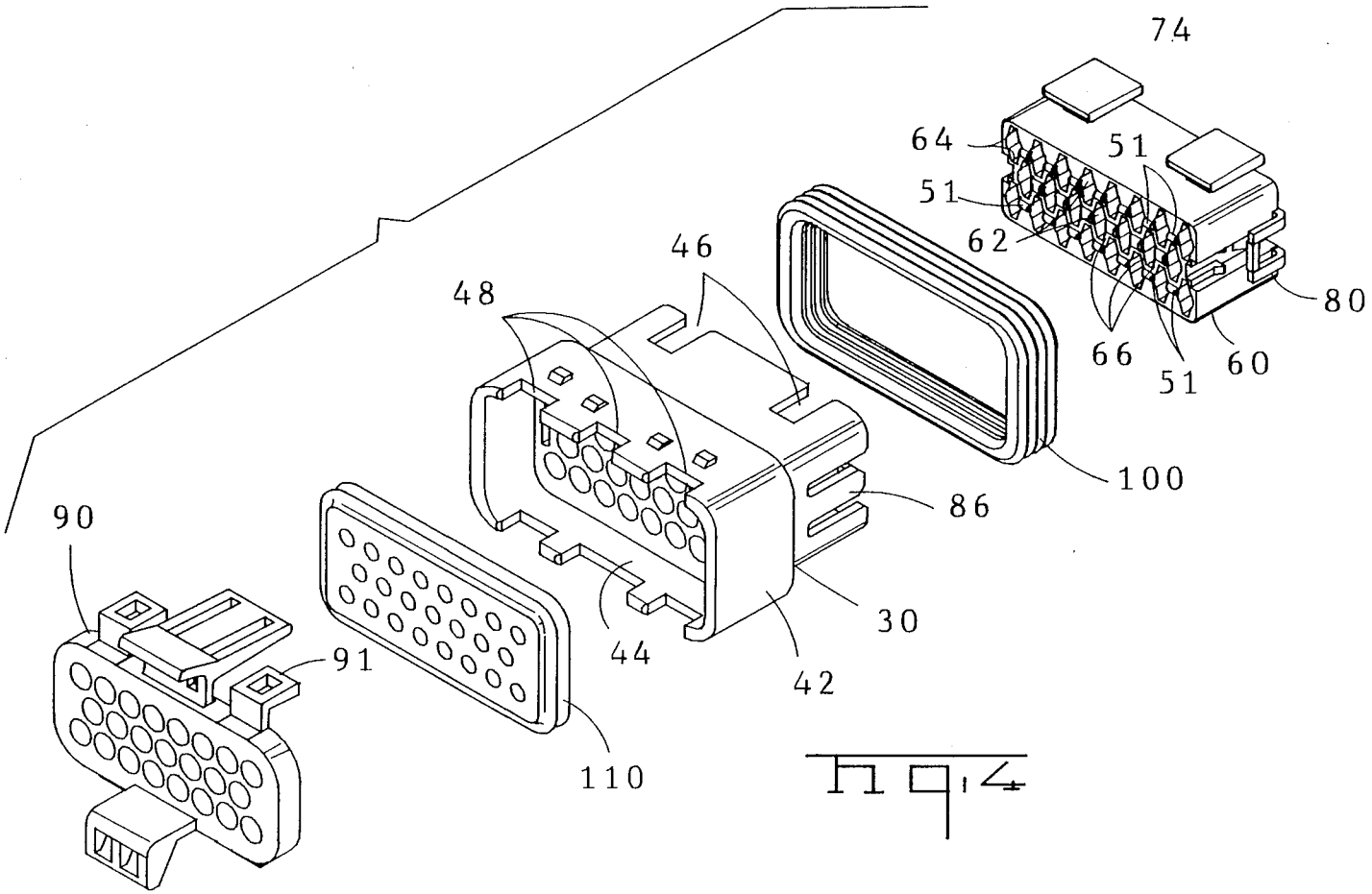
FIG. 4 is an exploded view showing the same parts as shown in FIG. 3 but showing the opposite faces of each component part.
Figure 6:
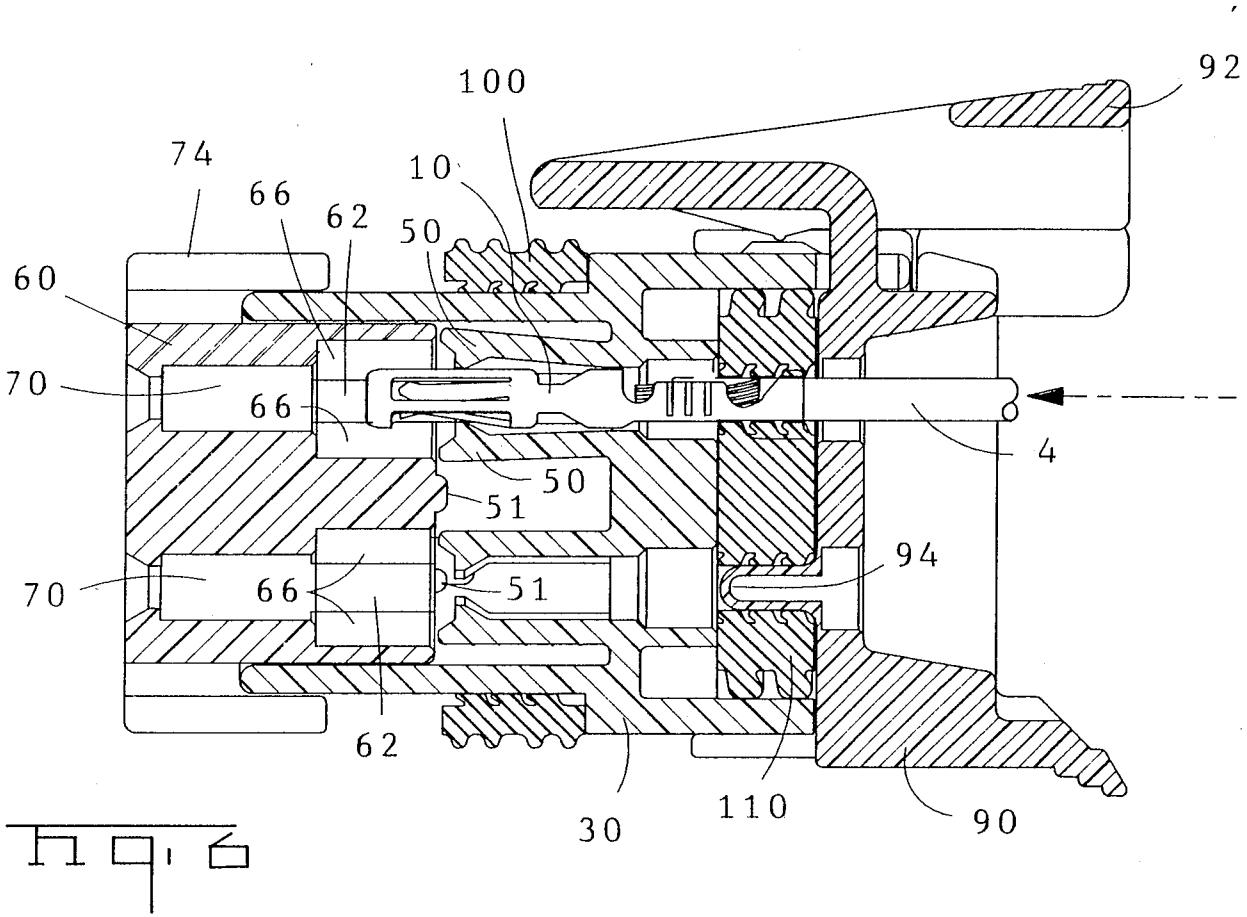
FIG. 6 is a sectional view of the receptacle connector showing initial insertion of a terminal into the connector housing.
Figure 7:
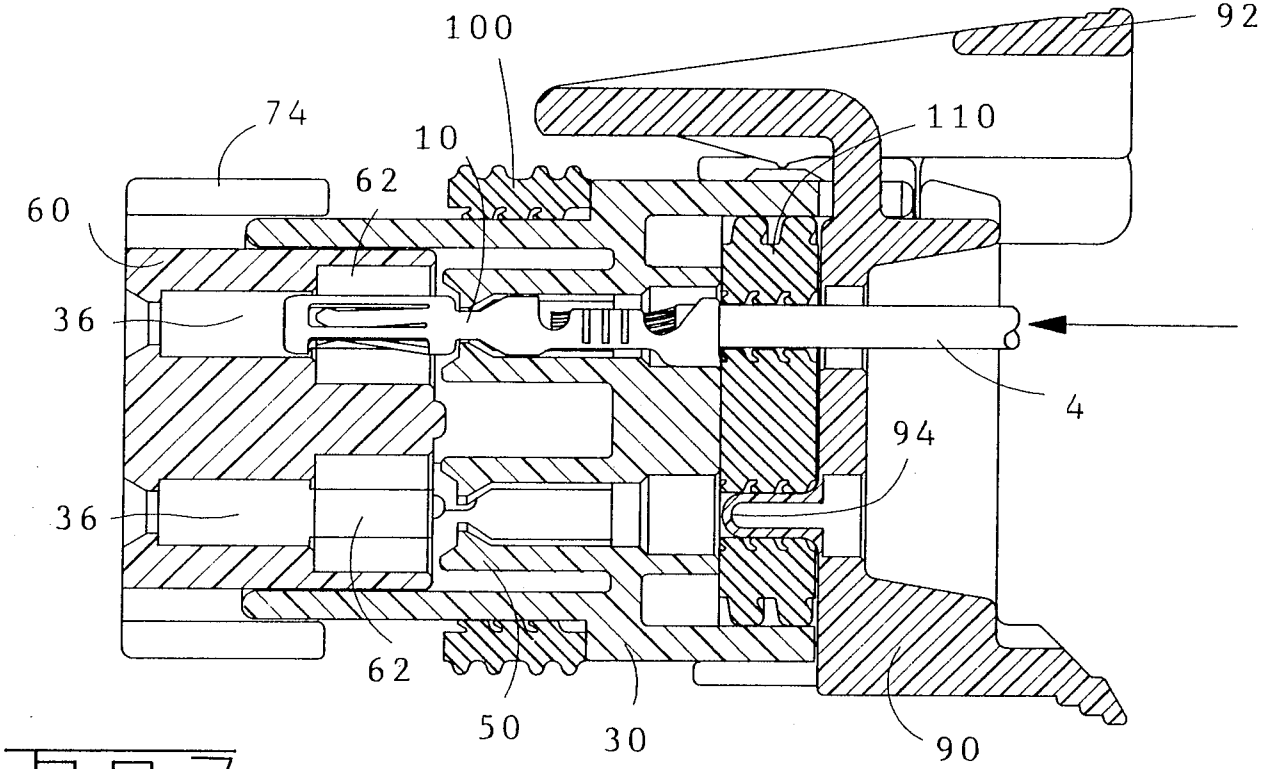
Figure 1:
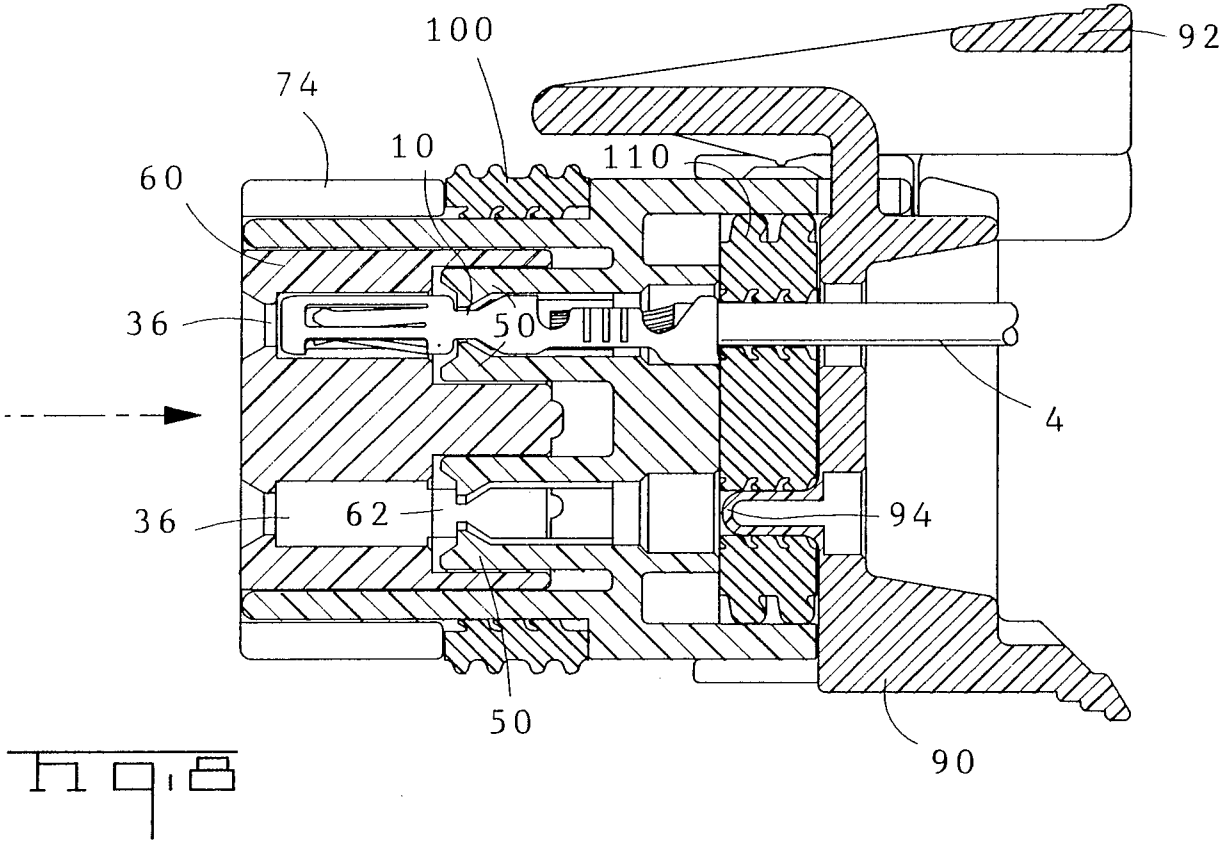

Secondary lock 60 can be attached to the insulative housing 30 in the first position of FIGS. 6 and 7 as well as in the second position shown in FIG. 8 by a two position retainer means comprising a finger 85 on the sidewalls 38 of the insulative housing 30 which is engagable with spaced apart mating shoulders 84 and 86 on the ends of the secondary lock 60. Referring to FIGS. 3, 20 and 21, the two position retainer means also includes an outer strap 80 which overlaps fingers 85 when the secondary lock 60 is in the closed second position. Mating shoulders 84 and 88 are located within a channel 82 on one end of the secondary lock 60. Two internal shoulders 84 are located on two spaced apart ridges **86*a* and 86*b* located adjacent to the edges of channel 82. Shoulders 84 include an inclined ramp surface facing the rear of the secondary lock 60 and a perpendicular locking shoulder section facing the outer or mating face of the secondary lock. The external shoulder 88 is located between the internal shoulders 84 and the mating face of the secondary lock 60. Outer shoulder 88 is centrally positioned with channel 82 laterally between the two spaced apart ridges 86***a* and 86*b* as shown in FIG. 20. When the secondary lock is in the first position as shown in FIGS. 6 and 7, an inwardly facing latching shoulder 85A on finger 85 engages the internal shoulders 84 on the secondary lock. In this position, locking shoulder 85*a* is positioned between the internal shoulder 84 and the external shoulder 88. In this position each finger 85 abuts the outer strap 80. Since each finger 85 cannot be shifted past the corresponding strap 80 into the closed position without first depressing each finger 85, the secondary lock 60 cannot be inadvertently shifted from the position of the secondary lock shown in FIG. 6 in which the subassembly is shipped. When the secondary lock 60 is shifted to the second position in FIG. 8, the lock and shoulder 85*a* is cammed outwardly over an inclined ramp surface on the external shoulder 88. When the secondary lock 60 is in the second position, the latching finger 85*a* is free to return to its normal position and the shoulder 85*a* will engage the locking surface on the outer face of external shoulder 88 to firmly secure the secondary lock 60 to the insulative housing 30.

As apparent from FIG. 6 the outer shroud surrounding the rows of latches 50 limits outward deflection of latches 50 adjacent this outer wall or shroud. Thus outwardly deflected latches 50 adjacent the outer shroud, such as the latch shown in FIG. 6, will not be broken when a force is applied to the secondary lock 60 in an attempt to shift the secondary lock from the first position shown in FIGS. 6 and 7 to the second position shown in FIG. 8. Since there are a plurality of rows of latches 50, the inner latches will not abut the outer wall. Protrusions 51 on the inner face of the secondary lock 60 provide a stop to limit deflection of inner latches. It is apparent from FIG. 6 that a deflected inner latch will engage a corresponding protrusion or bump located at the intersections of the diagonal wall sections 66 forming the pockets 62. These bumps 51 will thus prevent the inner latches 50 from spreading like the legs of a hog on ice.

A cap 90 is received within the shroud 42 at the rear of insulative housing 30. Cap 90 comprises both a seal cap used in conjunction with conductor seal 110 and a latching mechanism for securing connector 6 to a mating connector such as pin header 8. Cap 90 has a plurality of snaps 91 engagable with protrusions 43 on the exterior of shroud 42 to secure the cap 90 to the insulative housing 30 and to secure the conductor seal 110 within the insulative housing shroud 42. Cap 90 also has a connector latch 92 extending forwardly from its upper edge and protruding beyond the shroud 42 for securing the electrical connector 6 to mating header 8. By positioning this connector latch 92 on the cap 90, the insulative housing 30 can be more easily manipulated by automated equipment since the latch would not be in the way.

The elastomeric seal 110 used to establish sealing integrity around individual conductors or wires 4 comprises a single piece family seal formed of a conventional elastomeric material. Seal 110 has a plurality of holes 114, each hole being dimensioned to receive a wire and to establish sealing integrity with that wire. Seal 110 also has peripheral sealing ribs 112 for establishing sealing integrity with the interior surface of the shroud 42. Seal 110 comprises a conventional family seal for establishing sealing integrity with a plurality of individual conductors. Seal 110 is positioned within shroud 42, and each individual hole 114 will be aligned with an opening or cavity 36 in the insulative housing 30 and with a pocket 62 in the secondary lock 60.

Figures 17, 17A, 17B, 17C:
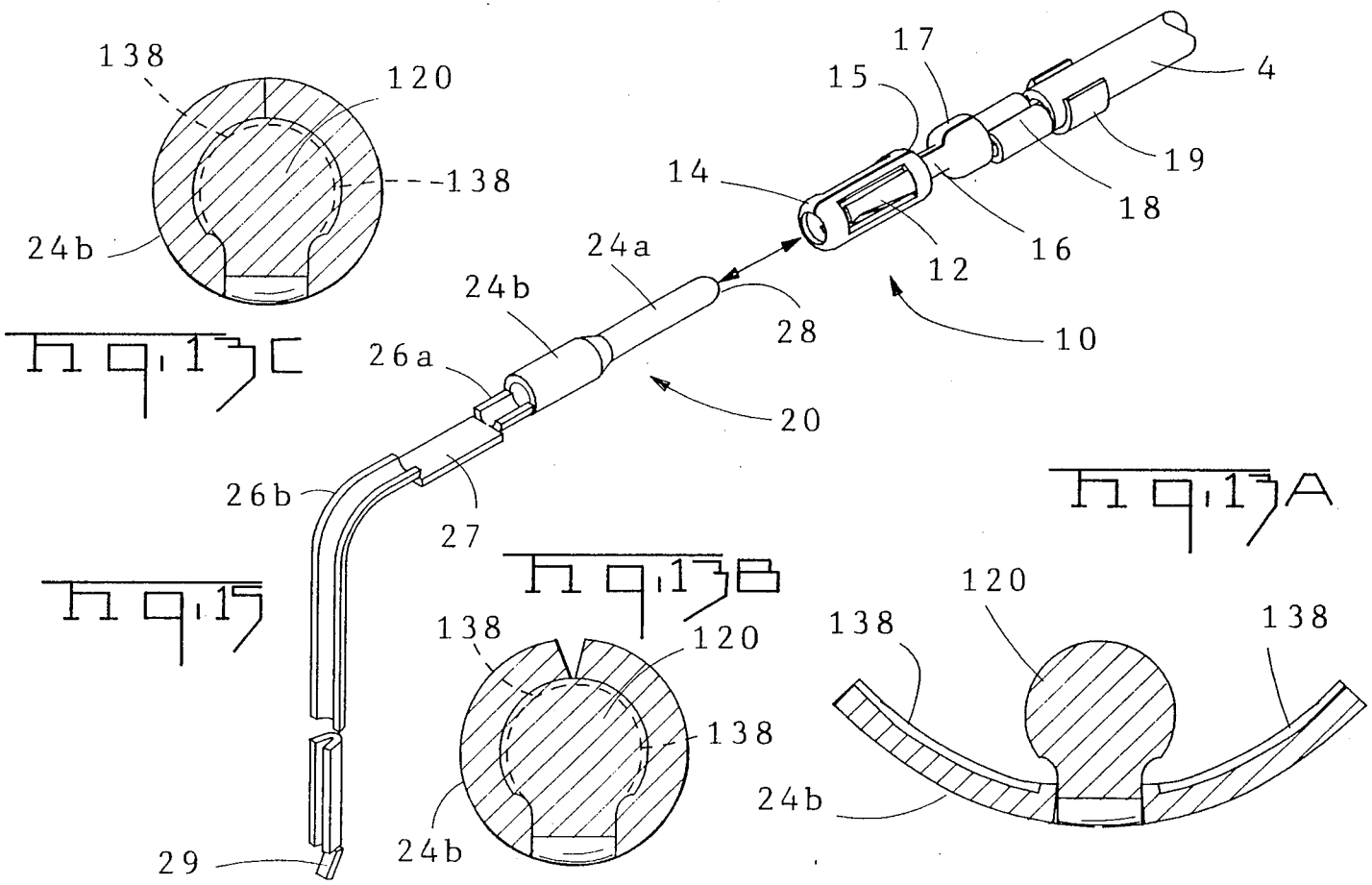
FIG. 17 is a perspective view showing a one piece family seal employed with electrical conductors and the seal cap, showing the manner in which the seal cap is programmed.
Figures 16, 17:
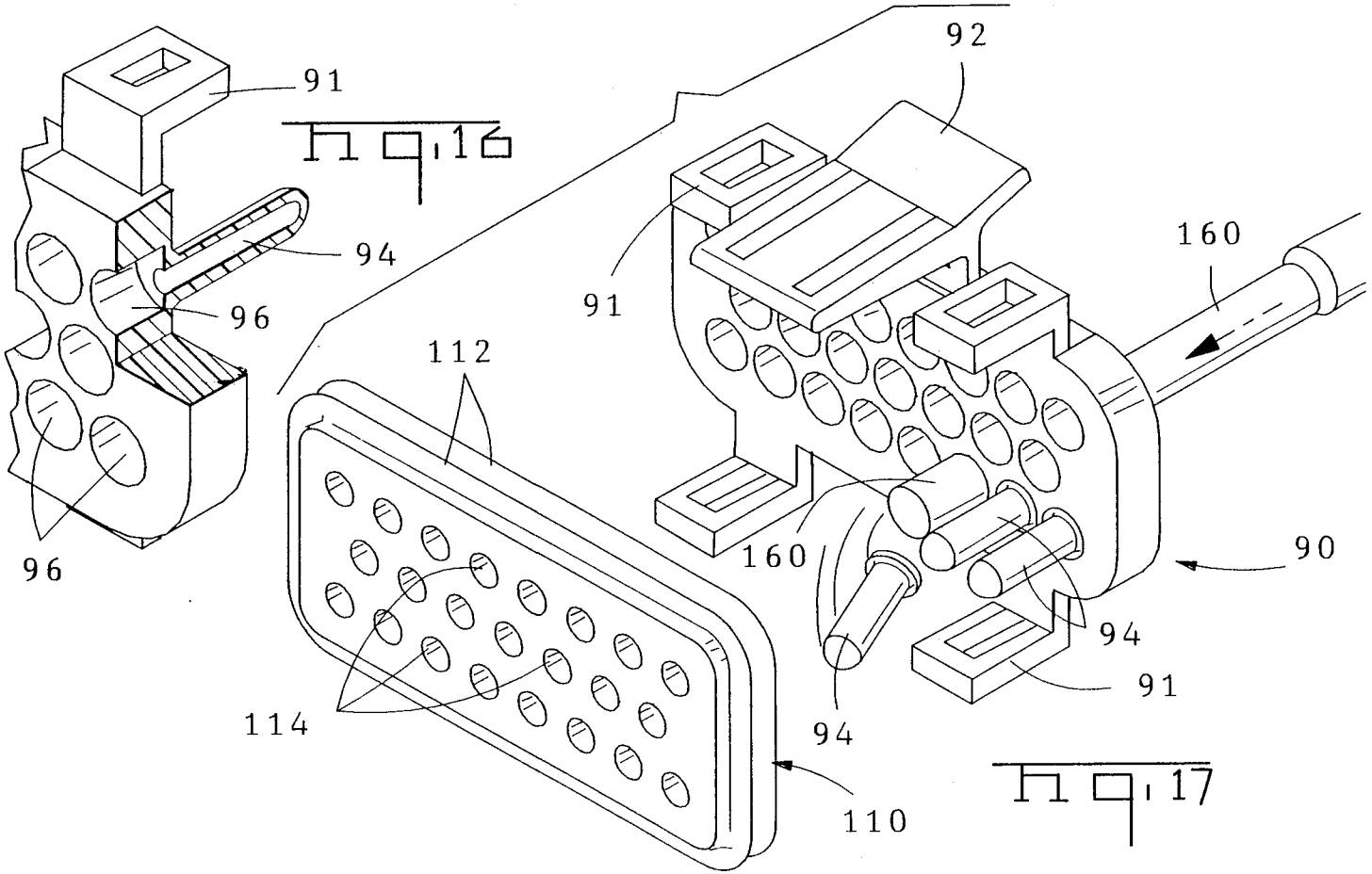
FIG. 16 is a fragmentary perspective view, partially in section, of the seal cap.

Although most conventional family seals such as seal 110 are intended for establishing sealing integrity with wires 4 inserted in all of the holes 114, means are provided on seal cap 90 for closing off any holes 114 in which no wire 4 is positioned. Seal cap 90 comprises a programmable plate. Programmable plate has a plurality of selectively removable projections 94 extending from one surface. These projections 94 are dimensioned for seating within a corresponding hole 114 on elastomeric seal 110. Cap 90 can be manufactured of a conventional plastic material with projections 94 located in a pattern corresponding to the array of terminal positions or corresponding to the array of holes 114 in the seal 110. Only selected or arbitrary terminal positions might be needed in certain applications of this sealed electrical connector assembly 2. Projections 94 can be removed from the seal cap programming plate only if those positions where a terminal is to be located. The remaining projections 94 can then extend through corresponding holes 114 in the elastomeric sealing member 110 thus providing closing holes 114 where no terminated wire is located. As shown in FIG. 16, seal cap 90 has a plurality of indentations 96 aligned with projections 94 on the opposite side of the plate. Selective projections can be removed by punching out the material in the corresponding indentation 96 using a suitable punching tool 160 in the manner shown in FIG. 17. Thus, sealed connector assembly 2 can be programmed for a specific application merely by punching out projections 94 on the plate 90.

Figure 2:
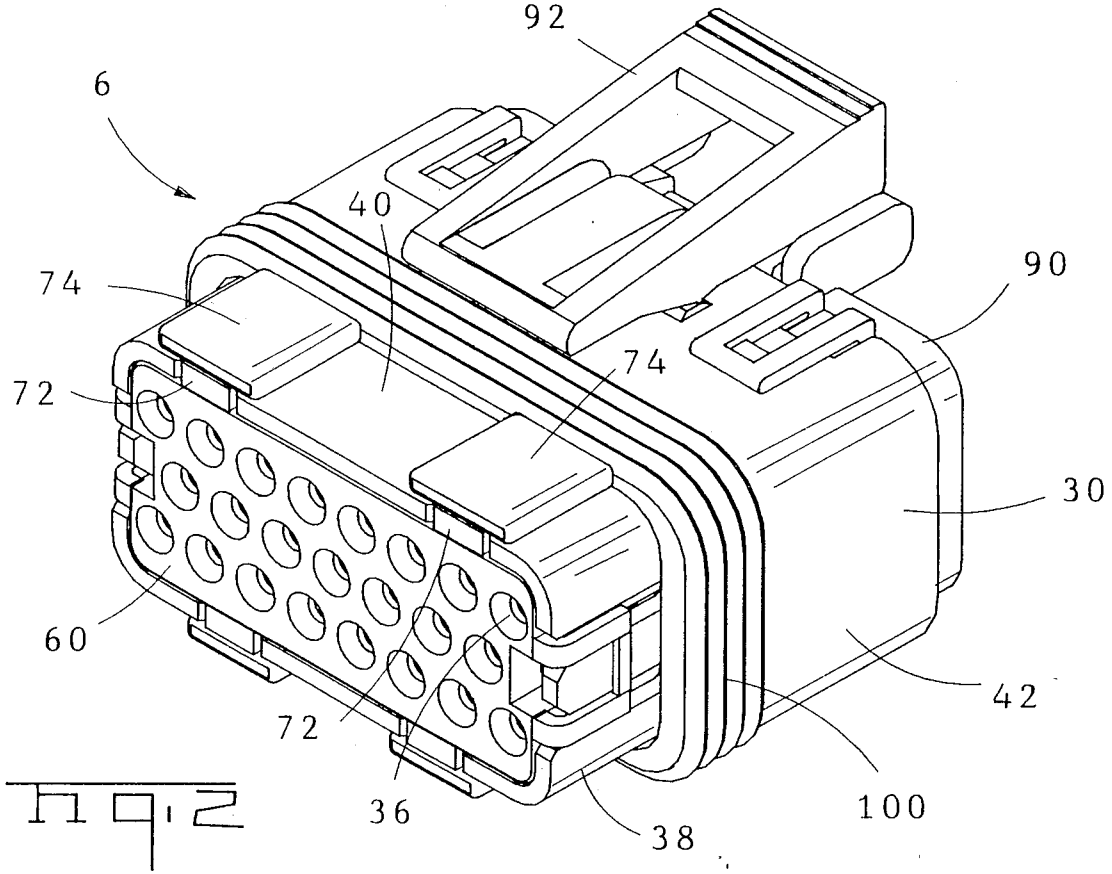
FIG. 2 is a perspective view of the receptacle connector in is fully assembled configuration.

In addition to the conductor seal 110, connector 6 includes a peripheral interfacial seal 100 located at the mating interface between connector 6 and pin header 8. As shown in FIG. 2, seal 100 is located between the secondary lock 60 and the shroud 42 on the insulative housing 30.

Although connector 6 could be used to establish an interconnection between two multi-conductor cables, connector 6 is preferably employed with a mating pin header 8. Pin header 8 includes a plurality of stamped and formed tubular or cylindrical pins 20. Each stamped and formed pin 20 has first and second tubular sections 24*a* and 24*b*. Each pin also has a third channel section 26 which in the preferred embodiment of this invention includes a right angle bend and a portion of channel 26*b*. Channel section 26 includes two spaced apart sections 26*a* and 26*b*. Section 26*a* is located adjacent the second or larger tubular section 24*b*. A flattened section 27 is located between the two channel shaped sections 26*a* and 26*a*. The first tubular section 24*a* has a tapered nose 28 formed in a conventional manner. The stamped and formed pin 20 is formed from a flat metal blank 130. Blank 130 has a first section 136*a* and a wider second section 136*b* from which the first and second tubular sections 24*a* and 24*b* respectively are formed. Since second section 136*b* is wider, the corresponding second tubular section 24*b* will have a larger outer diameter than the first tubular section 24*a*. To seal the leak path through the interior of the tubular pins 20, a plug 120 is located within the wider second tubular section 24*b*. Plug 120 establishes a metal to metal seal with the inner surface 22 of the tubular pin 20. Plug 120 is formed from a portion of the second tubular section 136*b* of the metal blank 130. Plug 120 is formed by partially shearing the plug from the center of the blank. Plug 120 remains joined to the blank 130 by an integral tail 128. The contour of the plug 120 around the tail 128 has substantially the same shape as the inner surface of the second tubular section **24*b* of the tubular pin 20. The outer contour of plug 120 thus has generally circular edges 126 which merge with concave radius edges or surfaces 124*a* and 124*b* which form the contour of the integral tail 128. Plug 120 is formed by bending the integral tail 128 upwardly and forming the wider section of the blank 136*b* around the integral plug 120. A metal to metal seal is thus formed by crimping a stamped and formed cylindrical pin around the generally circular plug 120. The width of the tab portion of the integral tail 128 is less than the inner diameter of the inner surface 22 of the tubular pin 20 in the second wider tubular section 24*b*. The blank is formed completely around the plug 120 including those portions of the integral tail 128 bent upwardly from the flat surface of the blank. However as shown in FIG. 13B, the diameter of the circular portion of the integral tail 128 is greater than the diameter of the inner surface 22 of the tubular pin 20 in the second wider tubular section 24*b*. To fully close the tubular section 24*b* around the circular portion of the integral tail 128 a radially constricting or crimping force must be applied to completely form the tubular section 24*b*. When the tubular section 24*b* is fully formed, as shown in FIG. 13C, a metal to metal sealed joint completely around the integral tail 128**.

Figures 9, 10, 11, 12:
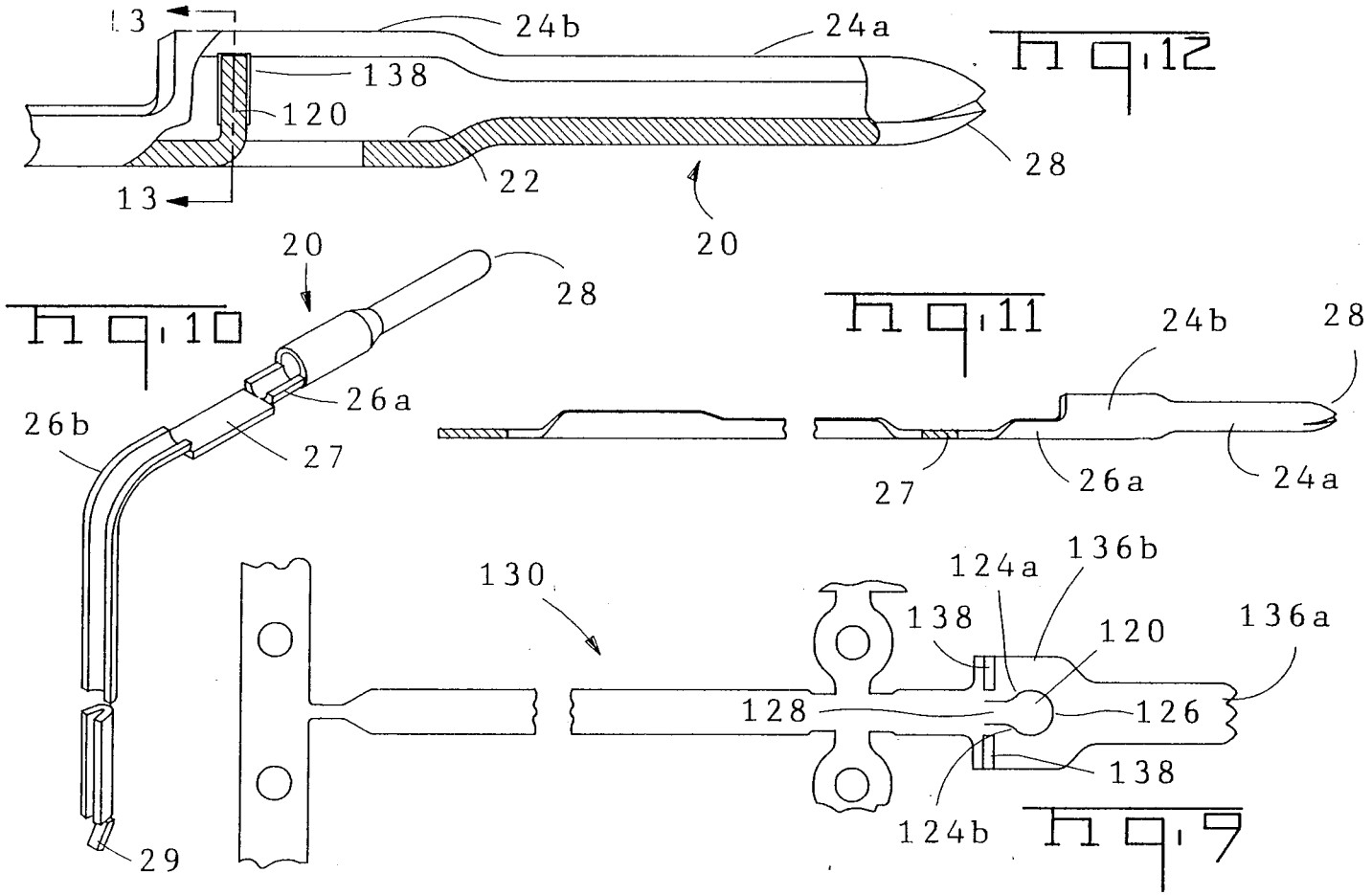
FIG. 9 shows a blank of the pin used in the pin header.
FIG. 10 is a perspective view of the fully stamped and formed pin.
FIG. 11 is a intermediate view of the stamped and formed pin prior to the time that the rear portion of the stamped and formed pin is bent in a right angle.
FIG. 12 is a view partially in section showing the manner in which the stamped and formed pin is plugged to seal a leak path through the interior of the stamped and formed pin.

In the preferred embodiment of this invention depressions 138 are formed on each side of the flat section **136*b*. These depressions 138 have a width substantially equal to the thickness of the blank and the edges of plug 120 are received within these depressions when the flat section 136*b* is formed around the plug to form the wider tubular section 24*b*. The manner in which this flat blank is formed around the integral plug 120** to form a seal for the leak path otherwise existing through the interior of the stamped and formed pin is best shown in FIG. 12, FIG. 13 and FIG. 13A.

Pins 20 are contained within a three row pin header 8 comprising a header housing 140 as best shown in FIGS. 1 and 5. The cylindrical or tubular portions of pins 20 extend into a header housing cavity 142 located on the front of a header bulkhead mounting section 144. A plurality of pin support platforms **146*a*, 146*b* and 146*c* extend from the rear of the header bulkhead section 144 in three rows. An angled bend is formed in channel section 26*b* of pins 20 and this right angle bend is located adjacent the rear edge of the pins 20 at the edges of platforms 146*a*, 146*b* and 146*c*. The plurality of pin stabilizing ribs 148 extend from the lower portion of the central header bulkhead 144 and have pin stabilizing ribs 148*a* and 148*b* located on opposed surfaces of pin stabilizing ribs 148. The channel shaped section on the rear of pins 20 fit within these pin stabilizing rib shoulders 148*a* and 148*b* to precisely position the pins for insertion into holes in a printed circuit board on which the header 8 is mounted. A plurality of keying ribs 150 are located on the inner surface of an outer header shroud 156 which forms the inner housing cavity 142 in which the receptacle connector 6 is inserted. These keying ribs 150 correspond to the profile of the support platforms 74 located on the secondary lock 60. When secondary lock 60 is properly positioned in the second position on the receptacle insulative housing 30, the receptacle connector 6 can be inserted into cavity 142 with platforms 74 being received between keying ribs 150. It should be noted that by properly positioning keying ribs 150 and by properly dimensioning the platform 74, the same basic connector can be used in a keyed configuration. Note that it would be possible to provide breakaway keying ribs 150 and breakaway platform sections 74 so that the same connectors could be easily keyed to prevent mating by improperly keyed connectors. The pin header housing 140 can be secured to a printed circuit board by the use of appropriate hold down members 154 of conventional construction. The receptacle connector 6 is secured to the header 8 by the connector latch 92 which engages latch shoulders 158 located on the exterior of the inner shroud 156 adjacent the mating face of the pin header 8**.

The components comprising the receptacle connector 6 can be assembled in a shipped configuration prior to insertion of wires 4 terminated to receptacle terminal 10. The secondary lock 60 can be secured to the mating face of the insulative housing 30 in the first position by the two position retainer means. Latch finger 85A would be in engagement with the internal shoulders 84 and would be positioned between the internal shoulder 84 and the external shoulder 88 in this first position. Interfacial seal 100 would be positioned in surrounding relationship to the sidewalls 40 and the endwalls 38 of the connector prior to assembly of the secondary lock 60 to the mating face of the insulative housing 30. Note that the platforms 74 located on the exterior of the sidewalls 40 will serve to retain the interfacial seal 100 on the exterior of the housing 30. Seal 110 can be inserted within housing shroud 42 and the cap 90 can be secured to the housing shroud. In the event that it is desirable to program the cap 92 by removing selected projections 94, the seal 110 and the cap 90 can be assembled to the insulative housing 30 at the time wires are inserted into the connector. After the selected projection has been removed, and other projections remain, cap 90 can be assembled to the connector with the projections 94 closing off any unused holes 114 in the manner shown in FIG. 6. Terminated wires can then be inserted through open holes 114. Latches 50 will be deflected outwardly during insertion of the terminals 10 in the manner shown in FIG. 6. Note that since the latches 50 have not yet entered pocket 62, these latches are free to expand outwardly when the secondary lock is in the first position. After the terminals have been positioned in the connector, the engaging surfaces 58 on latches 50 are received within the waist section 16 in engagement with the barrel shoulder 15. In this configuration the terminals cannot be withdrawn from housing 30. With the latches 50 properly positioned as shown in FIG. 7, the secondary lock 60 is then free to move from the first position shown in FIG. 7 to the second position shown in FIG. 8. In FIG. 8 the latches 50 are received within the pocket 62 and latches 50 are not free to expand. Note that if any terminal is not fully inserted, thus allowing engaging surfaces 58 to move into the smaller diameter waist section 16 of the terminals 10, the secondary lock cannot be moved to the second position shown in FIG. 8.

We claim:

1. An electrical connector comprising:

a plurality of terminals:

an insulative housing, the terminals being positioned rearwardly of a mating face of the insulative housing in at least two rows;

a plurality of latches comprising means for securing the terminals in the insulative housing; and a secondary housing member mountable in telescoping relationship to said mating face of the insulative housing, the secondary housing member having a plurality of pockets arranged in at least two rows, the latches being dimensioned to fit within corresponding pockets so that the secondary housing member can be telescopically shifted into surrounding relationship to the latches.

2. The electrical connector of claim 1 wherein each terminal is secured by two opposed latches, the two latches securing each terminal being received in the same pocket.

3. The electrical connector of claim 1 wherein the secondary housing member is retained on the insulative housing member by a two position retainer means, the secondary housing member being shiftable from a first position to a second position, the latches being received in respective pockets only in the second position.

4. The electrical connector of claim 1 wherein the terminals are positioned in three rows, the terminals in the center row being staggered with respect to the terminals in the outer two rows, the pockets in the secondary housing member also being in three rows with the pockets in the center row being suggested with respect to the outer two rows, the latches being positioned to enter the pockets in the secondary housing member when the terminals are properly secured in the insulative housing.

5. The electrical connector of claim 1 wherein terminals in adjacent rows are staggered.

6. The electrical connector of claim 5 wherein first latches securing terminals in one row at least partially overlap second latches securing terminals in an adjacent row.

7. The electrical connector of claim 6 wherein the pockets in one row at least partially overlap the pockets in an adjacent row.

8. The electrical connector of claim 7 wherein individual pockets are substantially diamond shaped with apices of pockets in adjacent rows overlapping.

9. The electrical connector of claim 8 wherein the secondary housing member has a base having a plurality of apertures, each aperture communicating with one aligned pocket.

10. The electrical connector of claim 9 wherein each latch has a tapered cross section so that exterior surfaces of each latch converge to an apex with distance away from the respective terminal.

11. An electrical connector comprising:

a plurality of terminals:

an insulative housing, the terminals being positioned within the insulative housing in at least two rows;

a plurality of latches comprising means for securing the terminals in the insulative housing, each latch having a tapered cross section so that the exterior surfaces of each latch converge to an apex with distance away from the respective terminal, the latches being positioned in at least two adjacent rows so the apices of latches in adjacent rows are staggered and juxtaposed;

a secondary housing member having a plurality of diagonal wall sections, the secondary housing member being attachable to the insulative housing so that each diagonal wall section fits between adjacent surfaces of two adjacent latches in two adJacent rows.

12. The electrical connector of claim 11 wherein the diagonal wall sections define a plurality of diamond shaped pockets, the latches being insertable in the diamond shaped pockets.

13. The electrical connector of claim 11 wherein the latches in one row at least partially overlap the latches in an adjacent row.

14. The electrical connector of claim 13 wherein the latches are resiliently deflectable, the diagonal wall sections being configured to fit between two adjacent latches only when the latches are in an undeflected configuration.

15. The electrical connector of claim 14 wherein the secondary housing member is mountable on the insulative housing, the secondary housing member being shiftable relative to the insulative housing member to a position with the diagonal wall sections fitting between two adjacent latches only when the latches are in an undeflected configuration.

16. The electrical connector of claim 14 wherein the insulative housing has a base having a plurality of openings in rows corresponding to rows of terminals, the latches comprising beams extending inwardly from the base.

17. The electrical connector of claim 11 wherein each terminal is secured in place by two opposed resilient latches on opposite sides of the row containing the terminal.

18. The electrical connector of claim 17 wherein the apices of latches in one row overlap the apices of latches in an adjacent row.

19. The electrical connector of claim 11 wherein the secondary housing member is retained in a first position on a mating face of the insulative housing, the secondary housing member being shiftable to a second position in which the diagonal wall sections fit between adjacent latches.

20. The electrical connector of claim 19 wherein the secondary housing member has a plurality of apertures in a outer partition, each aperture being offset from diagonal wall sections in the secondary housing member so that mating terminals can be received in the apertures.

21. An electrical connector for use in establishing a densely populated array of electrical connections, comprising:

a plurality of terminals arranged in at least three rows, terminals in a center row being staggered relative to terminals in two outer rows;

an insulative housing including means for positioning the terminals in three staggered rows;

a plurality of latches for securing the terminals in the insulative housing, the latches projecting toward a mating face on the insulative housing;

a secondary lock mountable on a mating face of the insulative housing, the secondary lock including means matable with the latches only when the terminals are properly secured in the insulative housing; and two position retainer means for attaching the secondary lock to the insulative housing in first and second alternative positions, the secondary lock being disengaged from the latches when the secondary lock is in the first position and engagable with the latches in the second position only when the terminals are properly secured in the insulative housing, the secondary lock being telescopically shiftable from the first to the second position.

22. The electrical connector of claim 21 wherein the two position retainer means comprises a finger on the insulative housing, an outer strap on the secondary lock, and two spaced apart shoulders on the secondary lock, the secondary lock being attached to the insulative housing in a first position with the finger being latched to one shoulder and abutting the outer strap, the secondary lock being shiftable to a second position by depressing the finger beneath the outer strap and shifting the finger into latching engagement with the second shoulder upon telescoping movement of the secondary lock toward the insulative housing.

23. The electrical connector of claim 21 wherein the insulative housing has a mating envelope formed by opposite endwalls and opposite sidewalls extending from the means for positioning the terminals toward the mating face, the latches being positioned within the envelope.

24. The electrical connector of claim 23 wherein the three rows extend between the opposite endwalls and parallel to the opposite sidewalls of the insulative housing, the two position retainer means comprising a finger in at least one of the endwalls and spaced apart mating shoulders on ends of the secondary lock.

25. The electrical connector of claim 24 wherein the two shoulders comprise an internal shoulder and an external shoulder, each shoulder being located in a channel on an end of the secondary lock.

26. The electrical connector of claim 25 wherein the internal shoulder comprises two spaced apart ridges adjacent edges of the channel and the external shoulder is centrally positioned within the channel laterally between the two spaced apart ridges.

27. The electrical connector of claim 23 wherein the insulative housing has a shroud at a rear end thereof, the shroud protruding beyond the sidewalls.

28. The electrical connector of claim 27 further comprising a cap received within the shroud at the rear end, the cap having a connector latch protruding beyond the shroud for securing the electrical connector to a mating connector.

29. The electrical connector of claim 27 wherein grooves are provided in each sidewall and interfitting tongues extend from sides of the secondary lock, the pattern of tongues and grooves providing keyed orientation between the housing and the secondary lock.

30. The electrical connector of claim 29 wherein each of the tongues has platform integral with the outermost end of the tongue, the platforms being positioned on the exterior of the sidewalls when the secondary lock is attached to the insulative housing.

31. The electrical connector of claim 21 wherein the secondary lock comprises a honeycomb structure having a plurality of pockets, individual latches being received within individual pockets when the secondary lock is in the second position.

32. The electrical connector of claim 31 wherein the honeycomb structure of the secondary lock is formed by a plurality of interwoven wall sections extending inwardly from a base, the base having a plurality of apertures, individual apertures communicating with individual pockets.

33. An electrical connector comprising:

a plurality of terminals;

an insulative housing, the terminals being positioned within the insulative housing in at least two rows;

a plurality of outwardly deflectable resilient latches comprising means for securing the terminals in the insulative housing when in an undeflected configuration;

a secondary lock movable telescopically between a first and a second position relative to the insulative housing when all of the latches are in the undeflected configuration, outwardly deflected latches abutting an inner face of the secondary lock to prevent movement of the secondary lock from the first to the second position, the inner face of the secondary lock having protrusions aligned with corresponding latches to limit outward deflection of the corresponding latch so that an outwardly deflected latch will not be broken when a force is applied to the secondary lock in an attempt to push the secondary lock from the first to the second position.

34. The electrical connector of claim 33 wherein the secondary lock has pockets in which undeflected latches are received when the secondary lock is in the second position.

35. The electrical connector of claim 34 wherein the insulative housing has a shroud surrounding a plurality of rows of latches, outwardly facing latches engaging the shroud to limit latch deflection, inwardly facing latches abutting the protrusions to limit latch deflection.

36. The electrical connector of claim 35 wherein each pocket has a diamond shape, a protrusion being located on at least one apex of each pocket.

37. The electrical connector of claim 36 wherein the pockets are defined by a plurality of diagonal walls, a protrusion being located at the intersection of diagonal walls.

38. The electrical connector of claim 37 wherein each protrusion comprises a convex bump.

* * * * *

UNITED STATES PATENT AND TRADEMARK OFFICE

CERTIFICATE OF CORRECTION

PATENT NO. : 4,973,268

DATED : November 27, 1990

INVENTOR(S) : Albert R. Smith & Allen F. VanDerStuyf

It is certified that error appears in the above-identified patent and that said Letters Patent is hereby corrected as shown below:

Claim 4, line 26, Column 11- The word "suggested" should be --staggered--.

Signed and Sealed this

Thirteenth Day of October, 1992

*Attest:*

DOUGLAS B. COMER

*Attesting Officer*

*Acting Commissioner of Patents and Trademarks*